US009668068B2

(12) United States Patent
Faltys et al.

(10) Patent No.: US 9,668,068 B2
(45) **Date of Patent: *May 30, 2017**

(54) BEAMFORMING MICROPHONE SYSTEM

(75) Inventors: Michael A. Faltys, Northridge, CA (US); Abhijit Kulkarni, Newbury Park, CA (US); Scott A. Crawford, Castaic, CA (US)

(73) Assignee: Advanced Bionics, LLC, Valencia, CA (US)

( * ) Notice: Subject to any disclaimer, the term of this patent is extended or adjusted under 35 U.S.C. 154(b) by 922 days.

This patent is subject to a terminal disclaimer.

(21) Appl. No.: 13/172,980

(22) Filed: Jun. 30, 2011

(65) Prior Publication Data

US 2011/0255725 A1 Oct. 20, 2011

Related U.S. Application Data

(63) Continuation of application No. 11/534,933, filed on Sep. 25, 2006, now Pat. No. 7,995,771.

(51) Int. Cl.
*H04R 25/00* (2006.01)

(52) U.S. Cl.
CPC ..... *H04R 25/407* (2013.01); *H04R 25/606* (2013.01)

(58) Field of Classification Search
CPC .. H04R 25/407; H04R 25/70; H04R 2225/41; H04R 25/405; H04R 25/50; H04R 25/552; H04R 1/245; H04R 2410/07; H04R 25/356; H04R 25/453; H04R 25/502; H04R 29/006; H04R 3/00; H04R 25/606; G10L 2021/02165; G10L 21/0208; G10L 2021/02166
USPC ..... 381/313, 92, 94.1, 328, 71.6
See application file for complete search history.

(56) References Cited

U.S. PATENT DOCUMENTS

| | | | |
|---|---|---|---|
| 3,751,605 | A | 8/1973 | Michelson |
| 4,051,330 | A | 9/1977 | Cole |
| 4,400,590 | A | 8/1983 | Michelson |
| 4,495,384 | A | 1/1985 | Scott et al. |

(Continued)

FOREIGN PATENT DOCUMENTS

| | | |
|---|---|---|
| WO | 96/39005 | 5/1996 |
| WO | 96/34508 | 10/1996 |

(Continued)

OTHER PUBLICATIONS

U.S. Appl. No. 11/089,171, Hahn, filed Mar. 24, 2005.

(Continued)

*Primary Examiner* — Davetta W Goins
*Assistant Examiner* — Phylesha Dabney
(74) *Attorney, Agent, or Firm* — Blank Rome, LLP

(57) ABSTRACT

A system and method for generating a beamforming signal is disclosed. A beam forming signal is generated by disposing a first microphone and a second microphone in horizontal coplanar alignment. The first and second microphones are used to detect a known signal to generate a first response and a second response. The first response is processed along a first signal path communicatively linked to the first microphone, and the second response is processed along a second signal path communicatively linked to the second microphone. The first and second responses are matched, and the matched responses are combined to generate the beamforming signal on a combined signal path.

25 Claims, 11 Drawing Sheets

(56) References Cited

U.S. PATENT DOCUMENTS

| | | | | |
|---|---|---|---|---|
| 4,532,930 | A | 8/1985 | Crosby et al. | |
| 4,793,353 | A | 12/1988 | Borkan | |
| 4,819,647 | A | 4/1989 | Byers et al. | |
| 5,033,090 | A | 7/1991 | Weinrich | |
| 5,201,006 | A | 4/1993 | Weinrich | |
| 5,204,917 | A | 4/1993 | Arndt et al. | |
| 5,357,576 | A | 10/1994 | Arndt | |
| 5,500,903 | A * | 3/1996 | Gulli | 381/92 |
| 5,597,380 | A | 1/1997 | McDermott et al. | |
| 5,601,617 | A | 2/1997 | Loeb et al. | |
| 5,603,726 | A | 2/1997 | Schulman et al. | |
| 5,626,629 | A | 5/1997 | Faltys et al. | |
| 5,749,912 | A | 5/1998 | Zhang et al. | |
| 5,824,022 | A | 10/1998 | Zilberman et al. | |
| 5,876,425 | A | 3/1999 | Gord et al. | |
| 5,938,691 | A | 8/1999 | Schulman et al. | |
| 5,991,663 | A | 11/1999 | Irlicht et al. | |
| 6,002,966 | A | 12/1999 | Loeb et al. | |
| 6,067,474 | A | 5/2000 | Schulman et al. | |
| 6,078,838 | A | 6/2000 | Rubinstein | |
| 6,129,753 | A | 10/2000 | Kuzma | |
| 6,154,678 | A | 11/2000 | Lauro | |
| 6,157,861 | A | 12/2000 | Faltys et al. | |
| 6,195,585 | B1 | 2/2001 | Karunasiri et al. | |
| 6,205,360 | B1 | 3/2001 | Carter et al. | |
| 6,208,882 | B1 | 3/2001 | Lenarz et al. | |
| 6,216,045 | B1 | 4/2001 | Black et al. | |
| 6,219,580 | B1 | 4/2001 | Faltys et al. | |
| 6,272,382 | B1 | 8/2001 | Faltys et al. | |
| 6,289,247 | B1 | 9/2001 | Faltys et al. | |
| 6,295,467 | B1 | 9/2001 | Kollmeier et al. | |
| 6,308,101 | B1 | 10/2001 | Faltys et al. | |
| 6,415,185 | B1 | 7/2002 | Maltan | |
| 6,522,764 | B1 | 2/2003 | Bøgeskov-Jensen | |
| 6,600,955 | B1 | 7/2003 | Zierhofer | |
| 6,658,125 | B1 | 12/2003 | Batting | |
| 6,700,983 | B1 | 3/2004 | Bøgeskov-Jensen | |
| 6,728,578 | B1 | 4/2004 | Voelkel | |
| 6,735,474 | B1 | 5/2004 | Loeb et al. | |
| 6,745,155 | B1 | 6/2004 | Andringa et al. | |
| 6,775,389 | B2 | 8/2004 | Harrison et al. | |
| 6,778,858 | B1 | 8/2004 | Peeters | |
| 6,826,430 | B2 | 11/2004 | Faltys et al. | |
| 6,842,647 | B1 | 1/2005 | Griffith et al. | |
| 6,980,864 | B2 | 12/2005 | Faltys et al. | |
| 7,003,876 | B2 | 2/2006 | Crawford et al. | |
| 7,039,466 | B1 | 5/2006 | Harrison et al. | |
| 7,043,303 | B1 | 5/2006 | Overstreet | |
| 7,043,304 | B1 | 5/2006 | Griffith et al. | |
| 7,054,691 | B1 | 5/2006 | Kuzma et al. | |
| 7,076,308 | B1 | 7/2006 | Overstreet et al. | |
| 7,082,332 | B2 | 7/2006 | Blamey et al. | |
| 7,107,101 | B1 | 9/2006 | Faltys | |
| 7,110,823 | B2 | 9/2006 | Whitehurst et al. | |
| 7,171,272 | B2 | 1/2007 | Blamey et al. | |
| 7,200,504 | B1 | 4/2007 | Fister | |
| 7,203,548 | B2 | 4/2007 | Whitehurst et al. | |
| 7,209,568 | B2 * | 4/2007 | Arndt et al. | 381/313 |
| 7,225,028 | B2 | 5/2007 | Della Santina et al. | |
| 7,242,985 | B1 | 7/2007 | Fridman et al. | |
| 7,248,926 | B2 | 7/2007 | Woods et al. | |
| 7,277,760 | B1 | 10/2007 | Litvak et al. | |
| 7,292,890 | B2 | 11/2007 | Whitehurst et al. | |
| 7,292,891 | B2 | 11/2007 | Hartley et al. | |
| 7,292,892 | B2 | 11/2007 | Litvak et al. | |
| 7,308,303 | B2 | 12/2007 | Whitehurst et al. | |
| 7,310,558 | B2 | 12/2007 | Van Hoesel | |
| 7,317,945 | B2 | 1/2008 | Litvak et al. | |
| 7,330,557 | B2 * | 2/2008 | Fischer et al. | 381/313 |
| 7,349,741 | B2 | 3/2008 | Maltan et al. | |
| 7,447,549 | B2 | 11/2008 | Litvak et al. | |
| 7,450,994 | B1 | 11/2008 | Mishra et al. | |
| 7,483,540 | B2 | 1/2009 | Rabinowitz et al. | |
| 7,490,044 | B2 | 2/2009 | Kulkarni | |
| 7,519,188 | B2 | 4/2009 | Berardi et al. | |
| 7,522,961 | B2 | 4/2009 | Fridman et al. | |
| 7,561,920 | B2 | 7/2009 | Faltys et al. | |
| 7,599,500 | B1 | 10/2009 | Segel et al. | |
| 7,702,396 | B2 | 4/2010 | Litvak et al. | |
| 7,729,758 | B2 | 6/2010 | Haller et al. | |
| 7,801,602 | B2 | 9/2010 | McClure et al. | |
| 7,822,480 | B2 | 10/2010 | Park et al. | |
| 7,860,570 | B2 | 12/2010 | Whitehurst et al. | |
| 7,864,968 | B2 | 1/2011 | Kulkarni et al. | |
| 7,945,064 | B2 | 5/2011 | O'Brien, Jr. et al. | |
| 2003/0044034 | A1 | 3/2003 | Zeng et al. | |
| 2004/0015205 | A1 | 1/2004 | Whitehurst et al. | |
| 2004/0082980 | A1 | 4/2004 | Mouine et al. | |
| 2004/0230254 | A1 | 11/2004 | Harrison et al. | |
| 2005/0102006 | A1 | 5/2005 | Whitehurst et al. | |
| 2005/0119716 | A1 | 6/2005 | McClure et al. | |
| 2005/0143781 | A1 | 6/2005 | Carbunaru et al. | |
| 2005/0213780 | A1 | 9/2005 | Berardi et al. | |
| 2005/0251225 | A1 | 11/2005 | Faltys et al. | |
| 2006/0100672 | A1 | 5/2006 | Litvak et al. | |
| 2006/0184212 | A1 | 8/2006 | Faltys et al. | |
| 2007/0016267 | A1 | 1/2007 | Griffin et al. | |
| 2007/0021800 | A1 | 1/2007 | Whitehurst et al. | |
| 2007/0055308 | A1 | 3/2007 | Haller et al. | |
| 2007/0260292 | A1 | 11/2007 | Faltys et al. | |

FOREIGN PATENT DOCUMENTS

| | | |
|---|---|---|
| WO | 97/48447 | 6/1997 |
| WO | 01/74278 | 10/2001 |
| WO | 03/015863 | 2/2003 |
| WO | 03/018113 | 3/2003 |
| WO | 03/030772 | 4/2003 |
| WO | 2004/043537 | 5/2004 |
| WO | 2005/097255 | 10/2005 |
| WO | 2006/053101 | 5/2006 |
| WO | 2007/030496 | 3/2007 |

OTHER PUBLICATIONS

U.S. Appl. No. 11/122,648, Griffith, filed Mar. 5, 2005.
U.S. Appl. No. 11/178,054, Faltys, filed Jul. 8, 2005.
U.S. Appl. No. 11/226,777, Faltys, filed Sep. 13, 2005.
U.S. Appl. No. 11/261,432, Mann, filed Oct. 28, 2005.
U.S. Appl. No. 11/262,055, Fridman, filed Dec. 28, 2005.
U.S. Appl. No. 11/386,198, Saoji, filed Mar. 21, 2006.
U.S. Appl. No. 11/387,206, Harrison, filed Mar. 23, 2006.
Carney, L.H., "A model for the responses of low-frequency auditory-nerve fibers in cat", Journal of the Acoustic Society of America, 93(1):401-417, 1993.
Deutsch, Sid, et al. (Eds.) "Understanding the Nervous System, An Engineering Perspective", New York, NY, IEEE Press, pp. 181-225, 1993.
Geurts, L. and J. Wouters, "Enhancing the speech envelope of continuous interleaved sampling processors for cochlear implants", Journal of the Acoustic Society of America, 105(4):2476-2484, 1999.
Moore, Brian C.J., "An Introduction to the Psychology of Hearing", San Diego, CA, Academic Press, pp. 9-12, 1997.
Rubinstein, J.T., et al., "The Neurophysiological Effects of Simulated Auditory Prosthesis Simulation", Second Quarterly Progress Report: NO1-DC-6-2111, May 27, 1997.
Srulovicz, P., et al., "A Central Spectrum Model: A Synthesis of Auditory-Nerve Timing and Place Cues in Monaural Communication of Frequency Spectrum", Journal of the Acoustic Society of America, 73(4): 1266-1276, 1983.
van Wieringen, A., et al., "Comparison of Procedures to Determine Electrical Stimulation Thresholds in Cochlear Implant Users", Ear and Hearing, 22(6): 528-538, 2001.
Zeng, F.G., et al., "Loudness of Simple and Complex Stimuli in Electric Hearing", Annals of Otology, Rhinology & Laryngology, 104 (No. 9, part 2, suppl. 166): 235-238, 1995.

* cited by examiner

BEAMFORMING MICROPHONE SYSTEM

CROSS-REFERENCE TO RELATED APPLICATIONS

This is a continuation of U.S. patent application Ser. No. 11/534,933, filed Sep. 25, 2006, which is incorporated herein by reference in its entirety and to which priority is claimed.

FIELD OF THE INVENTION

The present disclosure relates to implantable neurostimulator devices and systems, for example, cochlear stimulation systems, and to sound processing strategies employed in conjunction with such systems.

BACKGROUND

The characteristics of a cochlear implant's front end play an important role in the sound quality (and hence speech recognition or music appreciation) experienced by the cochlear implant (CI) user. These characteristics are governed by the components of the front-end including a microphone and an A/D converter in addition to the acoustical effects resulting from the placement of the CI microphone on the user's head. The acoustic characteristics are unique to the CI user's anatomy and the placement of the CI microphone on his or her ear. Specifically, the unique shaping of the user's ears and head geometry can result in substantial shaping of the acoustic waveform picked up by the microphone. Because this shaping is unique to the user and his/her microphone placement, it typically cannot be compensated for with a generalized solution.

The component characteristics of the microphone must meet pre-defined standards, and this issue can be even more critical in beamforming applications where signals from two or more microphones are combined to achieve desired directivity. It is critical for the microphones in these applications to have matched responses. Differences in the microphone responses due to placement on the patient's head can make this challenging.

Beamforming is an effective tool for focusing on the desired sound in a noisy environment. The interference of noise and undesirable sound tends to be very disturbing for speech recognition in everyday conditions, especially for hearing-impaired listeners. This is due to reduced hearing ability that lead, for example, to increased masking effects of the target signal speech.

A number of techniques based on single and multiple microphone systems have already been applied to suppress unwanted background noise. Single microphone techniques generally perform poorly when the frequency spectra of the desired and the interfering sounds are similar, and when the spectrum of the interfering sound varies rapidly. By using more than one microphone, sounds can be sampled spatially and the direction of arrival can be used for discriminating desired from undesired signals. In this way it is possible to suppress stationary and non-stationary noise sources independently of their spectra. An application for hearing aids requires a noise reduction approach with a microphone array that is small enough to fit into a Behind The Ear (BTE) device. As BTEs are limited in size and computing power, only directional microphones are currently used to reduce the effects of interfering noise sources.

SUMMARY

The methods and systems described herein implement techniques for clarifying sound as perceived through a cochlear implant. More specifically, the methods and apparatus described here implement techniques to implement beamforming in the CI.

In one aspect, a beamforming signal is generated by disposing a first microphone and a second microphone in horizontal coplanar alignment. The first and second microphones are used to detect a known signal to generate a first response and a second response. The first response is processed along a first signal path communicatively linked to the first microphone, and the second response is processed along a second signal path communicatively linked to the second microphone. The first and second responses are matched, and the matched responses are combined, to generate the beamforming signal on a combined signal path.

Implementations can include one or more of the following features. For example, matching the first and second responses can include sampling the first response and the second response at one or more locations along the first and second signal paths. In addition, a first spectrum of the sampled first response, a second spectrum of the sampled second response, and a third spectrum of the known signal can be generated. The first and second spectrums can be compared against the third spectrum, and a first filter and a second filter can be generated based on the comparisons. The first filter can be disposed on the first signal path and a second filter disposed on the second signal path.

In addition, implementations can include one or more of the following features. For example, a third filter can be disposed on the combined signal path to eliminate an undesired spectral transformation of the beamforming signal. The first and second microphones disposed in horizontal coplanar alignment can include a behind-the-ear microphone and an in-the-ear (ITE) microphone. The in-the-ear microphone is located in a concha of a cochlear implant user in horizontal coplanar alignment with the user's pinnae to optimize directivity at a high frequency band. Alternatively, the first and second microphones disposed in horizontal coplanar alignment can include two in-the-ear microphones. The two in-the-ear microphones are disposed in a concha of a cochlear implant user in horizontal coplanar alignment with the user's pinnae to optimize directivity at a high frequency band. The first and second microphones disposed in horizontal coplanar alignment can also include an in-the-ear microphone and a sound port communicatively linked to a behind-the-ear microphone. The sound port is located in horizontal coplanar alignment with the in-the-ear microphone, and the in-the-ear microphone is located in a concha of a cochlear implant user in horizontal coplanar alignment with the user's pinnae to optimize directivity at a high frequency band.

Implementations can further include one or more of the following features. The first and second microphones can be positioned to modulate a spacing between the first microphone and the second microphone to optimize directivity at a low frequency band. The behind-the-ear microphone can also include a second sound port designed to eliminate a resonance generated by the first sound port. The first sound port and the second sound port can be designed to have equal length and diameter in order to eliminate the resonance. Alternatively, a resonance filter can be generated to eliminate a resonance generated by the first sound port. The resonance filter includes a filter that generates a filter response having valleys at frequencies corresponding to locations of peaks of the resonance.

The techniques described in this specification can be implemented to realize one or more of the following advantages. For example, the techniques can be implemented to allow the CI user to use the telephone due to the location of the ITE microphone. Most hearing aids implement microphones located behind the ear, and thus inhibit the CI user from using the telephone. The techniques also can be implemented to take advantage of the naturally beamforming ITE microphone due to its location and the shape of the ear. Further, the techniques can be implemented as an extension of the existing ITE microphone, which eliminates added costs and redesigns of existing CI. Thus, beamforming can be implemented easily to current and future CI users alike.

These general and specific aspects can be implemented using an apparatus, a method, a system, or any combination of apparatuses, methods, and systems. The details of one or more implementations are set forth in the accompanying drawings and the description below. Further features, aspects, and advantages will become apparent from the description, the drawings, and the claims.

BRIEF DESCRIPTION OF THE DRAWINGS

Like reference symbols indicate like elements throughout the specification and drawings.

DETAILED DESCRIPTION

Figure 1:
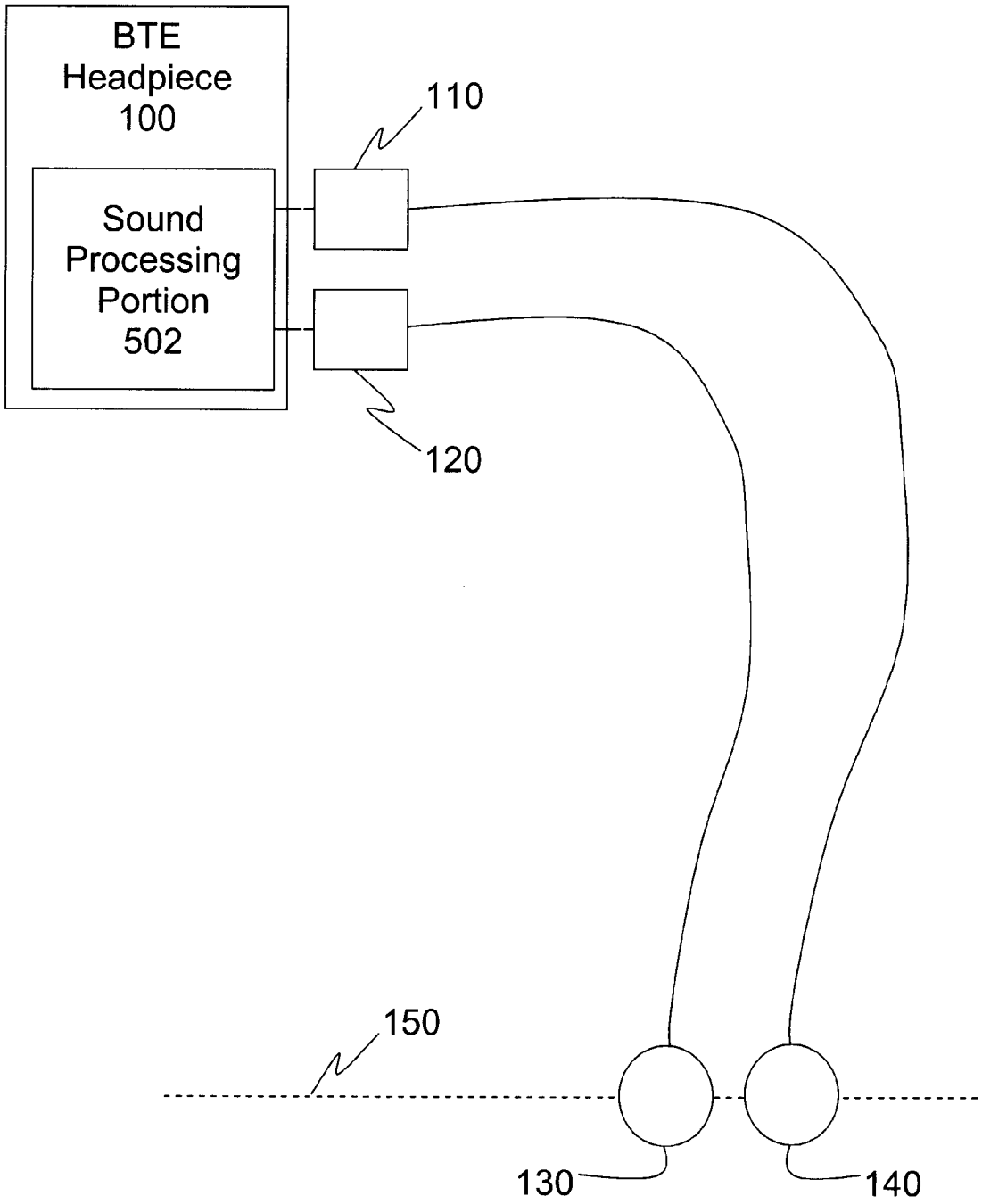
FIG. 1 is a block diagram of a microphone system including a first in-the-ear microphone in horizontal coplanar alignment with a second in-the-ear microphone.

A method and system for implementing a beamforming system are disclosed. A beamforming system combines sound signals received from two or more microphones to achieve directivity of the combined sound signal. Although the following implementations are described with respect to cochlear implants (CI), the method and system can be implemented in various applications where directivity of a sound signal and microphone matching are desired.

Applications of beamforming in CIs can be implemented using two existing microphones, a behind-the-ear (BTE) microphone and an in-the-ear (ITE) microphone. The BTE microphone is placed in the body of a BTE sound processor. Using a flexible wire, the ITE microphone is placed inside the concha near the pinna along the natural sound path. The ITE microphone picks up the natural sound using the natural shape of the ear and provides natural directivity in the high frequency without any added signal processing. This occurs because the pinna is a natural beam former. The natural shape of the pinna allows the pinna to preferentially pick up sound from the front and provides natural high frequency directivity. By placing the ITE microphone in horizontal coplanar alignment with the pinna, beamforming in the high frequencies can be obtained. U.S. Pat. No. 6,775,389 describes an ITE microphone that improves the acoustic response of a BTE Implantable Cochlear Stimulation (ICS) system during telephone use and is incorporated herein as a reference.

For beamforming, the microphones implemented must be aligned in a horizontal plane (coplanar). In addition, the spacing or distance between two microphones can affect directivity and efficiency of beamforming. If the spacing is too large, the directivity at high frequencies can be destroyed or lost. For example, a microphone-to-microphone distance greater than four times the wavelength ($\lambda$) cannot create effective beamforming. Also, the closer the distance, the higher the frequency at which beamforming can be created. However, the beamforming signal becomes weaker as the distance between the microphones is reduced since the signals from the two microphones are subtracted from each other. Therefore, the gain in directivity due to the closeness of the distance between the microphones also creates a loss in efficiency. The techniques disclosed herein optimize the tradeoff between directivity and efficiency.

To maximize beamforming, the microphones are positioned horizontally coplanar to each other, which can be accomplished in one of several ways. For example, an ITE microphone can be positioned to be aligned with a BTE microphone, but such alignment would result in a loss of the natural beamforming at higher frequencies since the ITE microphone will no longer be placed near the pinna. Therefore, in one aspect of the techniques, the BTE microphone is positioned to align with the ITE microphone. Since the pinna provides free (without additional processing) and natural high frequency directivity, the BTE microphone can be moved in coplanar alignment with the ITE microphone. Directivity for lower frequencies can be designed by varying the distance between the two microphones.

Microphone System Design Strategies

FIG. 1 illustrates a beamforming strategy implementing two ITE microphones 130, 140 positioned inside the concha near the pinna and in co-planar alignment 150 with each other. The ITE microphones 130, 140 can be communicatively linked to a sound processing portion 502 of a BTE headpiece 100 using a coaxial connection 110, 120 or other suitable wired or wireless connections. The distance between the two ITE microphones 130, 140 are adjusted to optimize beamforming in the lower frequencies (e.g., 200-300 Hz). Because the ITE microphones 130, 140 are in horizontal coplanar alignment 150 with the pinna, natural beamforming in the higher frequencies (e.g., 2-3 KHz) is achieved naturally. Additional benefits may be achieved from this implementation. For example, by locating both microphones in the concha near the pinna, the CI user is able to use the telephone. When the earpiece of the telephone is placed on the ear, the earpiece seals against the outer ear and effectively creates a sound chamber, reducing the amount of outside noise that reaches the microphone located in the concha and near the pinnae.

Figure 2:
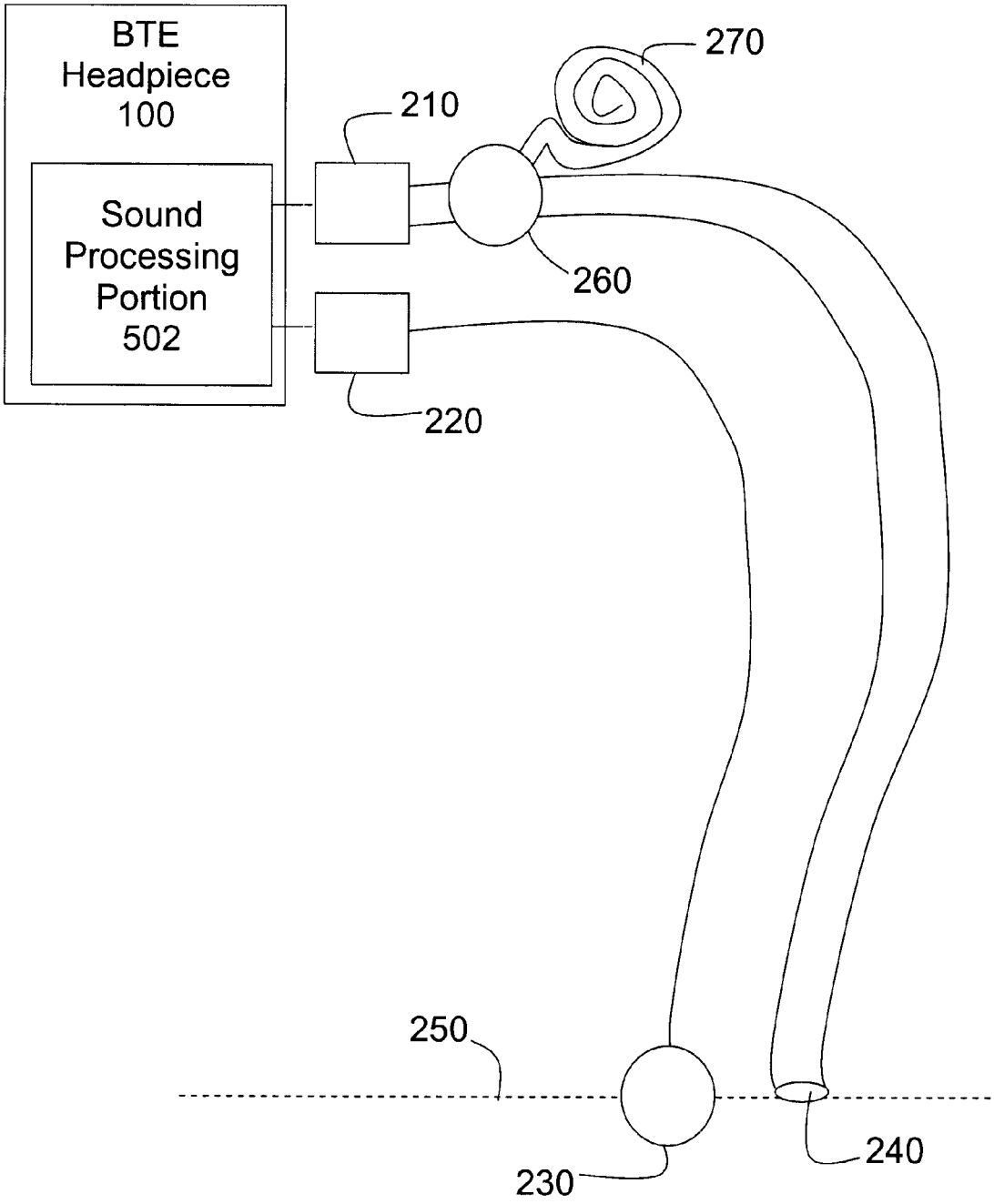
FIG. 2 shows a functional block diagram of a microphone system including an in-the-ear microphone in horizontal coplanar alignment with a sound port communicatively linked to an internal behind-the-ear microphone.

In some implementations, an ITE microphone 230 is implemented in horizontal coplanar alignment 250 with a sound port 240 as shown in FIG. 2. Using the sound port 240 avoids the need to place two microphones in the concha near the pinna, especially when there is not enough space to accommodate both microphones. The sound port 240 is communicatively linked to and channels the sound to a second microphone 260 located behind the ear or in other suitable locations. The second microphone 260 can either be an ITE microphone or a BTE microphone. For example, the sound port 240 alleviates the need to reposition the BTE microphone and allows the beamforming to be implemented in existing CI users with an existing BTE microphone located in the body of the BTE headpiece 100. Similar to the microphone configuration described in FIG. 1, both microphones 230, 260 are communicatively linked to a sound processing portion 502 located inside a BTE headpiece 100 using a coaxial connection 210, 220 or other suitable wired or wireless connections.

Figure 3:
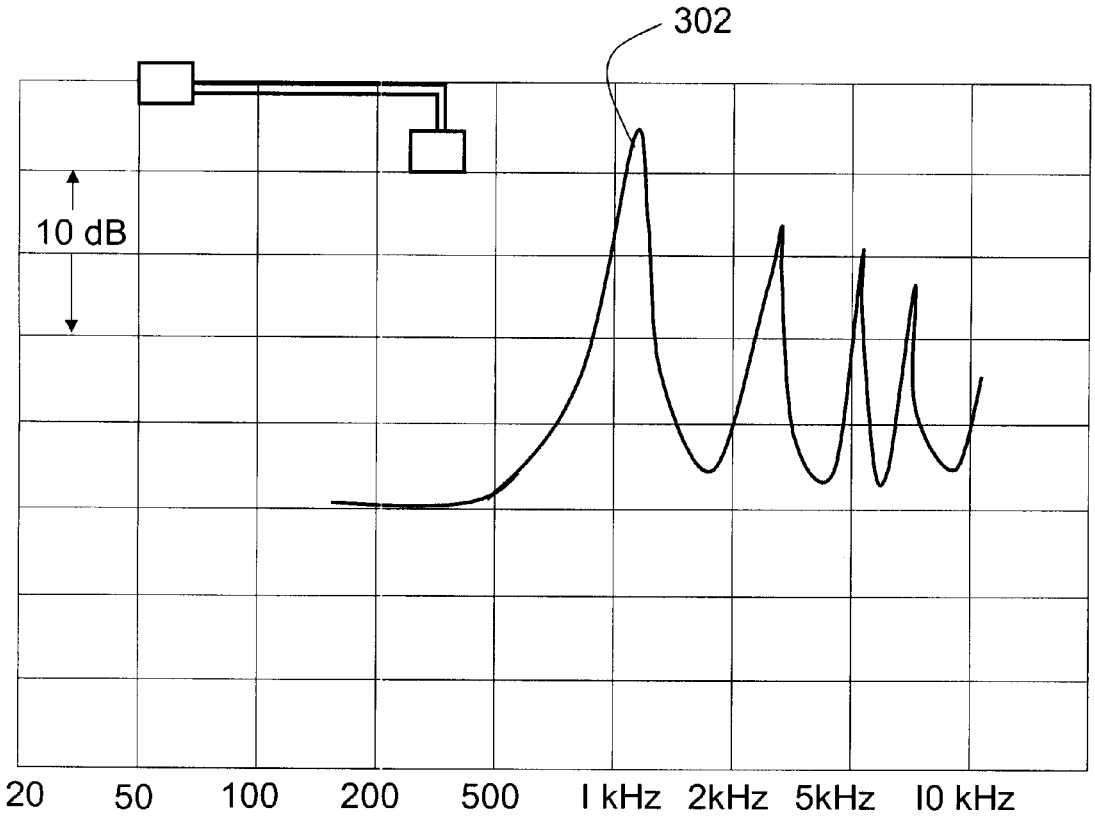
FIG. 3 is a chart representing a resonance created by a sound port.

One undesired effect of the sound port 240 is an introduction of resonance or unwanted peaks in the acoustical signal. FIG. 3 illustrates an existence of resonance 302 due to the sound port 240. Assume that the sound port 240 is a lossless tube. Then the signal received by the microphone coupled to the sound port 240 will have a quarter wavelength resonance at f=86/L, where L is the length of the sound port 240 in mm and f is the frequency in kHz. In addition, peaks will be present corresponding to ¾, ⁵⁄₄, ⁷⁄₄, etc. resonances.

In order to help eliminate the undesired effect, a digital filter can be implemented to compensate for the resonance created. The digital filter can be designed to filter out the peaks of the resonance by generating valleys at frequency locations of the peaks. Alternatively, a smart acoustical port design can be implemented with an anti-resonance acoustical structure. The smart acoustical port design includes a second, complementary sound port 270 configured to create a destructive resonance to cancel out the original resonance. The second sound port 270 is of equal length and diameter as the first sound port 240. However, the shape or position of the tube does not affect the smart acoustical port design. Consequently, the second sound port 270 can be coiled up and hidden away.

Figure 4:
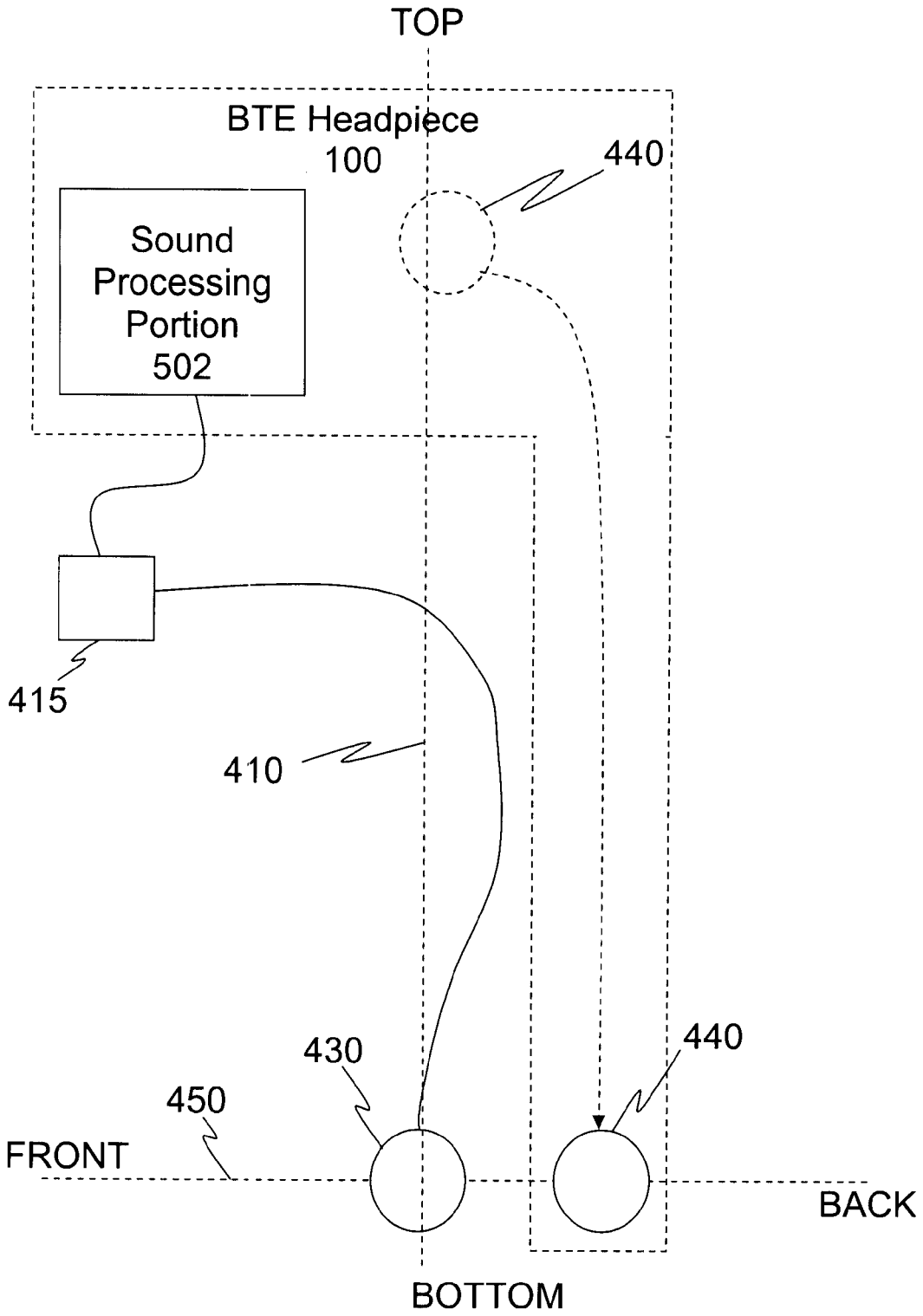
FIG. 4 presents a functional diagram of a microphone system including an in-the-ear microphone in horizontal coplanar alignment with an internal behind-the-ear microphone.

In some implementations, as described in FIG. 4, an existing microphone design is utilized to reposition an existing BTE microphone 440 located in the body of the BTE head piece 100. In general, the BTE microphone 440 and the ITE microphone 430 are in a vertical (top-down) arrangement 410. Such vertical arrangement 410 fails to provide a horizontal coplanar alignment, and thus is not conducive to a beamforming strategy. To achieve beamforming, the desired geometric arrangement of the BTE microphone and the ITE microphone is a horizontal coplanar alignment 450. For example, the ITE microphone and the BTE microphone can be arranged in a front-back (horizontal) arrangement to provide a coplanar alignment 450. By simply moving the location of the BTE microphone 440, the overall design of the CI need not be changed, and only the location of the BTE microphone is modified.

As with the other microphone designs, having alignment with the pinnae provides natural beamforming at the high frequency range, and the distance between the two microphones 430, 440 is adjusted to achieve beamforming at the low frequency range. Similar to the microphone strategy described in FIGS. 1 and 2, the ITE microphone 430 is communicatively linked to a sound processing portion 502 located inside a BTE headpiece 100 using a coaxial connection 415 or other suitable wired or wireless connections.

Microphone Matching

In general, microphones used in beamforming applications are matched microphones. These matched microphones are sorted and selected by a microphone manufacturer for matching characteristics or specifications. This is not only time consuming but also increases the cost of the microphones. In addition, even if perfectly matching microphones could be implemented in a CI, the location of the microphones and shape and physiology of the CI user's head introduces uncertainties that create additional mismatches between the microphones.

In one aspect, a signal processing strategy is implemented to match two unmatched microphones by compensating for inherent characteristic differences between the microphones in addition to the uncertainties due to the physiology of the CI user's head. Matching of the two microphones is accomplished by implementing a process for customizing an acoustical front end as disclosed in U.S. Pat. No. 7,864,968. The techniques of this patent can be implemented to compensate for an undesired transformation of the known acoustical signal due to the location of the microphones and the shape of the CI user's head including the ear. The techniques also eliminate the need to implement perfectly matched microphones.

Figure 5A:
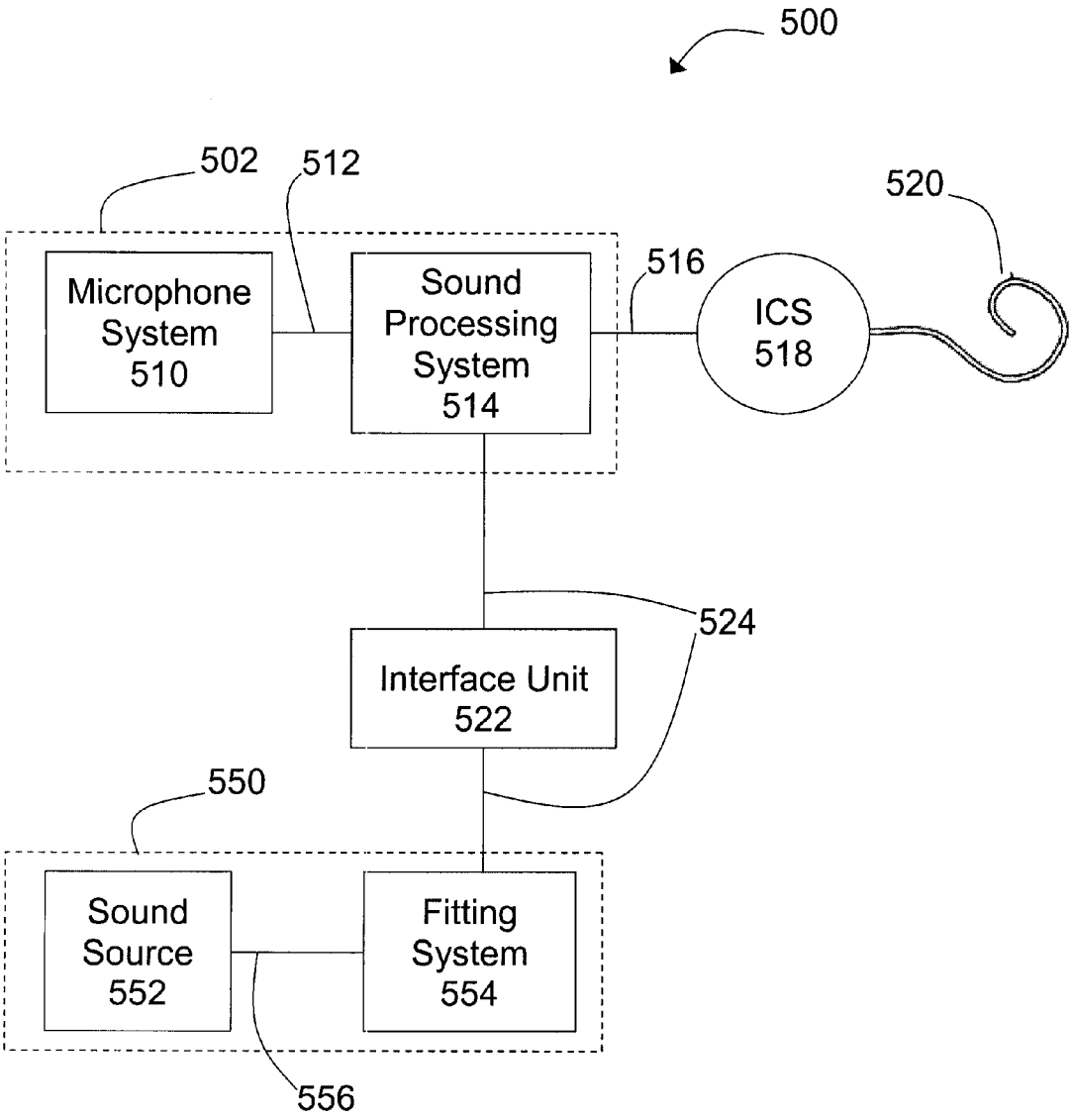
FIG. 5A is a functional block diagram of a beamforming customization system.

FIG. 5A presents a beamforming customization system 500 comprising a fitting portion 550 in communication with a sound processing portion 502. The fitting portion 550 can include a fitting system 554 communicatively linked with an external sound source 552 using a suitable communication link 556. The fitting system 554 may be substantially as shown and described in U.S. Pat. Nos. 5,626,629 and 6,289,247, both patents incorporated herein by reference.

In general, the fitting portion 550 is implemented on a computer system located at an office of an audiologist or other medical personnel and is used to perform an initial fitting or customization of a cochlear implant for a particular user. The sound processing portion 502 is implemented on a behind the ear (BTE) headpiece 100 (FIGS. 1, 2 and 4), which is shown and described in U.S. Pat. No. 5,824,022, and U.S. Pat. No. 7,242,985, the patents incorporated herein by reference. The sound processing portion 502 can include a microphone system 510 communicatively linked to a sound processing system 514 using a suitable communication link 512. The sound processing system 514 is coupled to the fitting system 554 through an interface unit (IU) 522, or an equivalent device. A suitable communication link 524 couples the interface unit 522 with the sound processing system 514 and the fitting system 554. The IU 522 can be included within a computer as a built-in I/O port including but not limited to an IR port, serial port, a parallel port, and a USB port.

The fitting portion 550 can generate an acoustic signal, which can be picked up and processed by the sound processing portion 502. The processed acoustic signal can be passed to an implantable cochlear stimulator (ICS) 518 through an appropriate communication link 516. The ICS 518 is coupled to an electrode array 520 configured to be inserted within the cochlea of a patient. The implantable cochlear stimulator 518 can apply the processed acoustic signal as a plurality of stimulating inputs to a plurality of electrodes distributed along the electrode array 520. The electrode array 520 may be substantially as shown and described in U.S. Pat. Nos. 4,819,647 and 6,129,753, both patents incorporated herein by reference.

In some implementations, both the fitting portion 550 and the sound processing portion 502 are implemented in the external BTE headpiece 100 (FIGS. 1, 2 and 4). The fitting portion 550 can be controlled by a hand-held wired or wireless remote controller device (not shown) by medical personnel or the cochlear implant user. The implantable cochlear stimulator 518 and the electrode array 520 can be an internal or implanted portion. Thus, a communication link 516 coupling the sound processing system 514 and the implanted portion can be a transcutaneous (through the skin) link that allows power and control signals to be sent from the sound processing system 514 to the implantable cochlear stimulator 518.

In some implementations, the sound processing portion 502 is incorporated into an internally located implantable cochlear system (not shown) as shown and described in a co-pending U.S. Patent Pub. No. 2007/0260292.

The implantable cochlear stimulator can send information, such as data and status signals, to the sound processing system 514 over the communication link 516. In order to facilitate bidirectional communication between the sound processing system 514 and the implantable cochlear stimulator 518, the communication link 516 can include more than one channel. Additionally, interference can be reduced by transmitting information on a first channel using an amplitude-modulated carrier and transmitting information on a second channel using a frequency-modulated carrier.

The communication links 556 and 524 are wired links using standard data ports such as Universal Serial Bus interface, IEEE 1394 FireWire, or other suitable serial or parallel port connections.

In some implementations, the communication links 556 and 524 are wireless links such as the Bluetooth protocol. The Bluetooth protocol is a short-range, low-power 1 Mbit/sec wireless network technology operated in the 2.4 GHz band, which is appropriate for use in piconets. A piconet can have a master and up to seven slaves. The master transmits in even time slots, while slaves transmit in odd time slots. The devices in a piconet share a common communication data channel with total capacity of 1 Mbit/sec. Headers and handshaking information are used by Bluetooth devices to strike up a conversation and find each other to connect. Other standard wireless links such as infrared, wireless fidelity (Wi-Fi), or any other suitable wireless connections can be implemented. Wi-Fi refers to any type of IEEE 802.11 protocol including 802.11a/b/g/n. Wi-Fi generally provides wireless connectivity for a device to the Internet or connectivity between devices. Wi-Fi operates in the unlicensed 2.4 GHz radio bands, with an 11 Mbit/sec (802.11b) or 54 Mbit/sec (802.11a) data rate or with products that contain both bands. Infrared refers to light waves of a lower frequency out of range of what a human eye can perceive. Used in most television remote control systems, information is carried between devices via beams of infrared light. The standard infrared system is called infrared data association (IrDA) and is used to connect some computers with peripheral devices in digital mode.

In implementations whereby the implantable cochlear stimulator 518 and the electrode array 520 are implanted within the CI user, and the microphone system 510 and the sound processing system 514 are carried externally (not implanted) by the CI user, the communication link 516 can be realized through use of an antenna coil in the implantable cochlear stimulator and an external antenna coil coupled to the sound processing system 514. The external antenna coil can be positioned to be in alignment with the implantable cochlear stimulator, allowing the coils to be inductively coupled to each other and thereby permitting power and information, e.g., the stimulation signal, to be transmitted from the sound processing system 514 to the implantable cochlear stimulator 518.

In some implementations, the sound processing system 514 and the implantable cochlear stimulator 518 are both implanted within the CI user, and the communication link 516 can be a direct-wired connection or other suitable links as shown in U.S. Pat. No. 6,308,101, incorporated herein by reference.

Figure 5B:
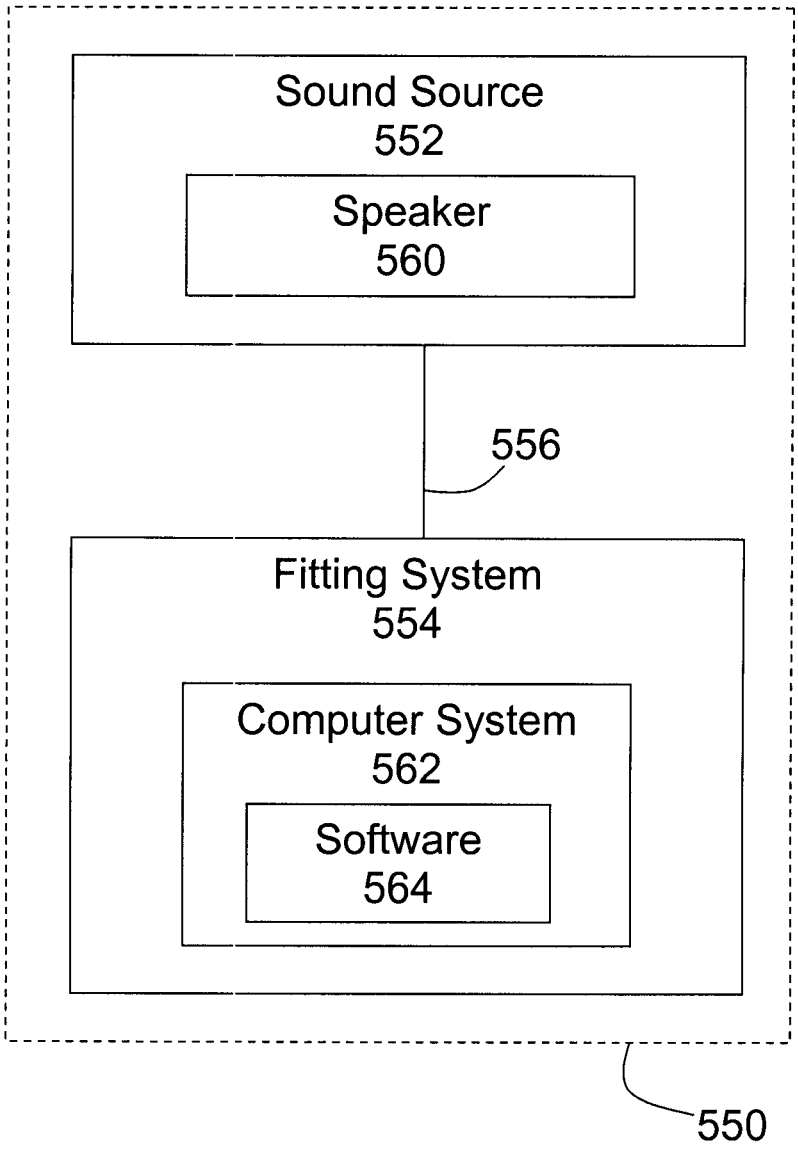
FIG. 5B is a detailed view of a fitting portion.

FIG. 5B describes the major subsystems of the fitting system 550. In one implementation, the fitting system 550 includes fitting software 564 executable on a computer system 562 such as a personal computer, a portable computer, a mobile device, or other equivalent device. The computer system 562, with or without the IU 522, generates input signals to the sound processing system 514 that stimulate acoustical signals detected by the microphone system 510. Depending on the situation, input signals generated by the computer system 562 can replace acoustic signals normally detected by the microphone system 510 or provide command signals that supplement the acoustic signals detected through the microphone system 510. The fitting software 564 executable on the computer system 562 can be configured to control reading, displaying, delivering, receiving, assessing, evaluating and/or modifying both acoustic and electric stimulation signals sent to the sound processing system 514. The fitting software 564 can generate a known acoustical signal, which can be outputted through the sound source 552. The sound source 552 can include one or more acoustical signal output devices such as a speaker 560 or equivalent device. In some implementations, multiple speakers 560 are positioned in a 2-D array to provide directivity of the acoustical signal.

The computer system 562 executing the fitting software 564 can include a display screen for displaying selection screens, stimulation templates and other information generated by the fitting software. In some implementations, the computer system 562 includes a display device, a storage device, RAM, ROM, input/output (I/O) ports, a keyboard, and a mouse. The display screen can be implemented to display a graphical user interface (GUI) executed as a part of the software 564 including selection screens, stimulation templates and other information generated by the software 564. An audiologist, other medical personnel, or even the CI user can easily view and modify all information necessary to control a fitting process. In some implementations, the fitting portion 550 is included within the sound processing system 514 and can allow the CI user to actively perform cochlear implant front end diagnostics and microphone matching.

In some implementations, the fitting portion 550 is implemented as a stand-alone system located at the office of the audiologist or other medical personnel. The fitting portion 550 allows the audiologist or other medical personnel to customize a sound processing strategy and perform microphone matching for the CI user during an initial fitting process after the implantation of the CI. The CI user can return to the office for subsequent adjustments as needed. Return visits may be required because the CI user may not be fully aware of his/her sound processing needs initially, and the user may need time to learn to discriminate between different sound signals and become more perceptive of the sound quality provided by the sound processing strategy. In addition, the microphone responses may need periodic calibrations and equalizations. The fitting system 554 is implemented to include interfaces using hardware, software, or a combination of both hardware and software. For example, a simple set of hardware buttons, knobs, dials, slides, or similar interfaces can be implemented to select and adjust fitting parameters. The interfaces can also be implemented as a GUI displayed on a screen.

In some implementations, the fitting portion 550 is implemented as a portable system. The portable fitting system can be provided to the CI user as an accessory device for allowing the CI user to adjust the sound processing strategy and recalibrate the microphones as needed. The initial fitting process may be performed by the CI user aided by the audiologist or other medical personnel. After the initial fitting process, the user may perform subsequent adjustments without having to visit the audiologist or other medical personnel. The portable fitting system can be implemented to include simple user interfaces using hardware, software, or a combination of both hardware and software to facilitate the adjustment process as described above for the stand alone system implementation.

Figure 5C:
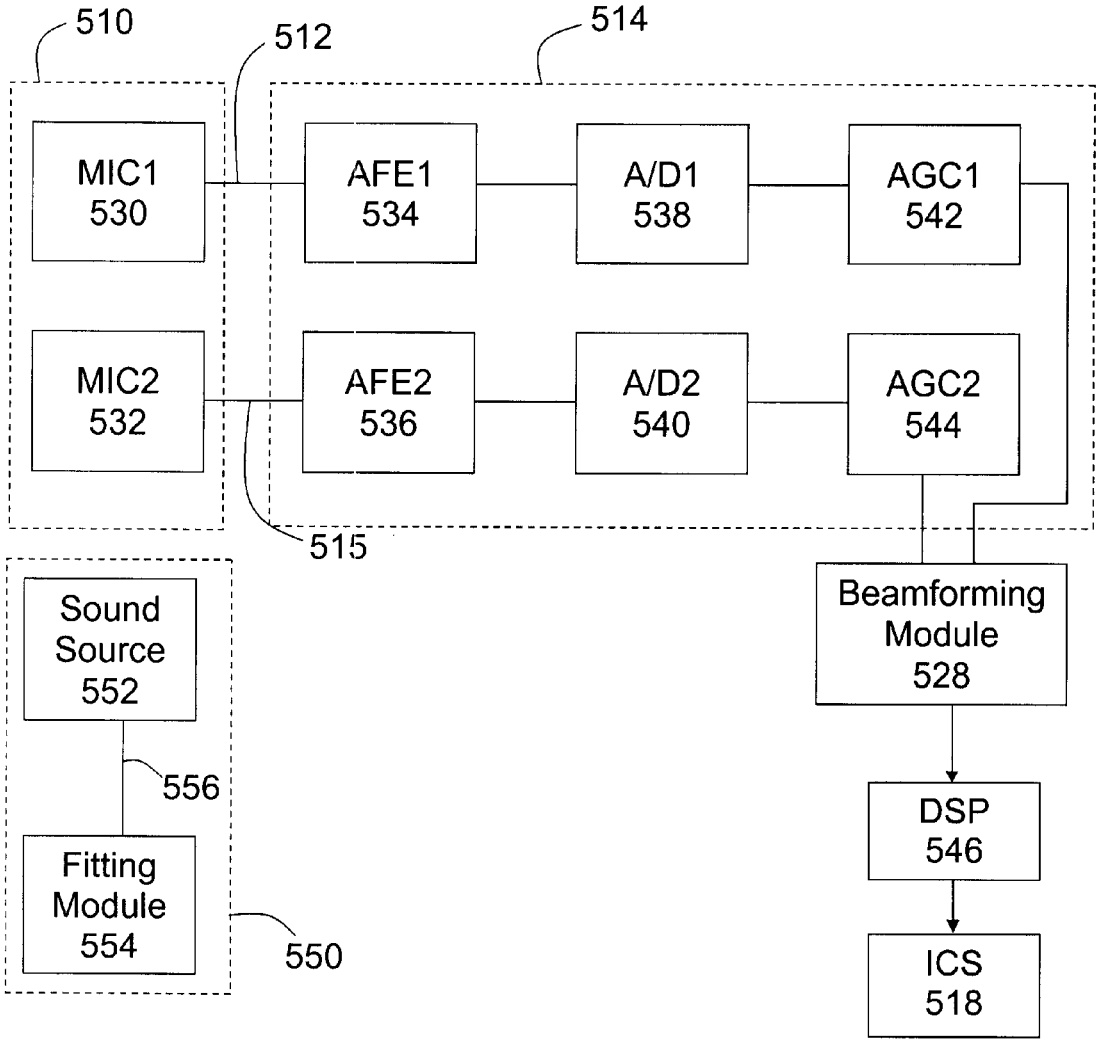
FIG. 5C is a detailed view of two signal paths

FIG. 5C shows a detailed view of the signal processing system 514. A known acoustic signal (or stimulus) generated by a sound source 552 is detected by microphones 530, 532. The detected signal is communicated along separate signal paths 512, 515 and processed. Processing the known acoustical stimulus includes converting the stimulus to an electrical signal by acoustic front ends (AFE1 and AFE2) 534, 536, along each signal path 512, 515. A converted electrical signal is presented along each signal path 512, 515 of the sound processing system 514. Downstream from AFE1 and AFE2, the electrical signals are converted to a digital signal by analog to digital converters (A/D1 and A/D2) 538, 540. The digitized signals are amplified by automatic gain controls (AGC1 and AGC2) 542, 544 and delivered to a beamforming module 528 to achieve a beamforming signal. The beamforming signal is processed by a digital signal processor (DSP) 546 to generate appropriate digital stimulations to an array of stimulating electrodes in a Micro Implantable Cochlear Stimulator (ICS) 518.

The microphone system 510 can be implemented to use any of the three microphone design configurations as described with respect to FIGS. 1-4 above. In some implementations, the microphone system 510 can include more than two microphones positioned in multiple locations.

Microphone matching is accomplished by compensating for an undesired transformation of the known acoustical signal detected by the microphones 530, 532 due to the inherent characteristic differences in the microphones 530, 532, locations of the microphones 530, 532 and the physiological properties of the CI user's head and ear. A microphone matching process includes sampling the detected signal along the signal paths 512, 515 and matching the responses from the microphones 530, 532.

Figure 5D:
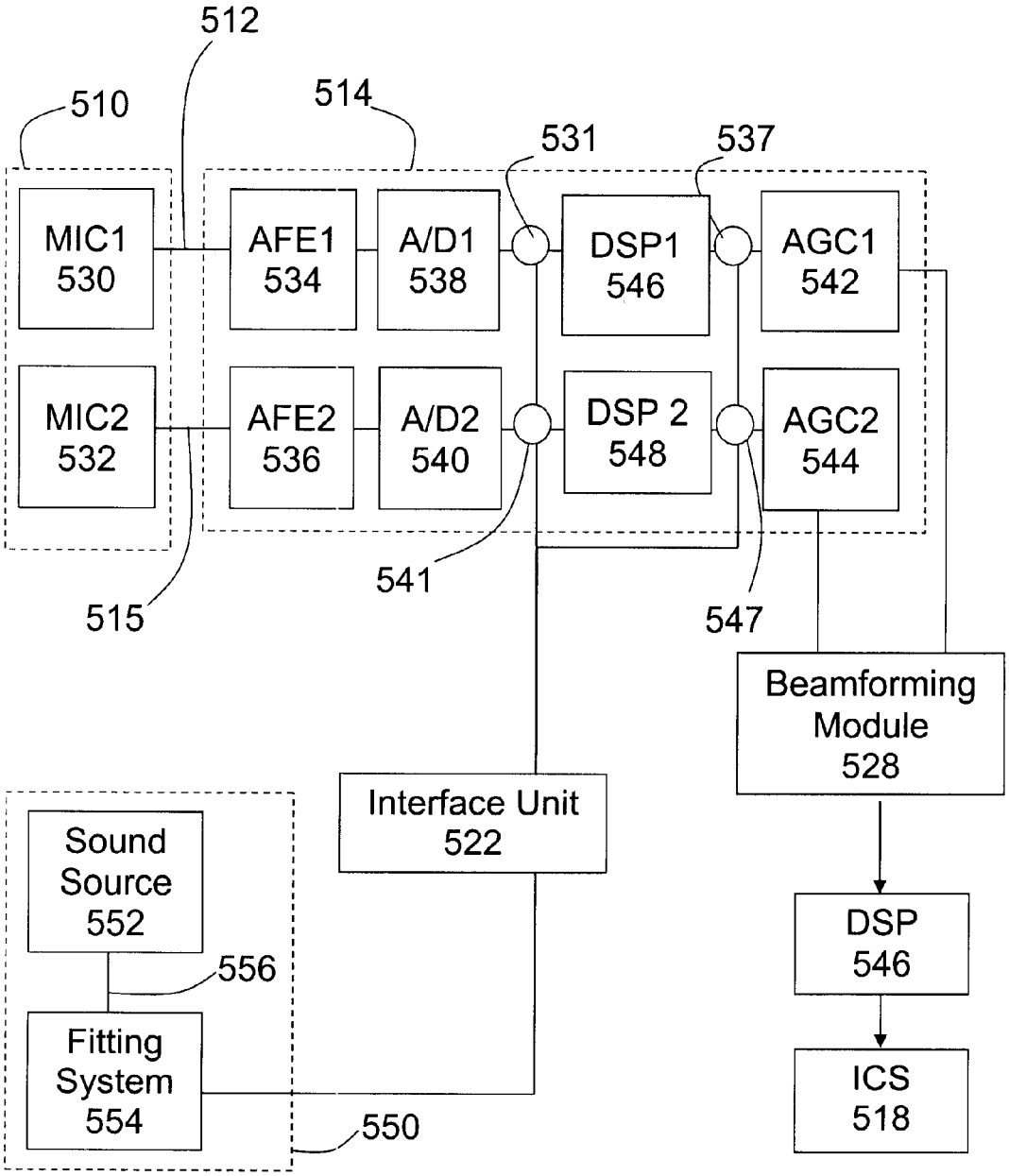
FIG. 5D is a detailed view of sampling locations along the two signal paths.

FIG. 5D describes multiple signal sampling locations along the signal paths 512 and 515. For example, signal sampling locations 531 and 537 can be provided along the signal path 512 and signal sampling locations 541 and 547 can be provided along the signal path 515. The fitting system 554 generates a known audio signal, and the generated audio signal is received by the microphone system 510 using microphones 530 and 532. The received signal is passed along signal paths 512, 515 as microphone responses. The responses from the microphones 530, 532 are sampled at one or more locations (e.g., 537) along the signal pathways 512 and 515 of the sound processing system 514. Response sampling can be performed through the IU 522 and analyzed by the fitting system 554. The sampled responses are compared with the known audio signal generated by the fitting system 554 to determine an undesired spectral transformation of the sampled signal at each signal path 512 and 515. The undesired spectral transformation can depend at least on the positioning of the microphones 530 and 532, mismatched characteristics of the microphones 530 and 532, and physical anatomy of the user's head and ear. The undesired transformation is eliminated by implementing one or more appropriate digital equalization filters at the corresponding sampling location, 537, to filter out the undesired spectral transformation at each signal path 512, 515. While only two sampling locations for each signal path 512 and 515 are illustrated in FIG. 5D, the total number of sampling locations per signal path can vary depending on the type of signal processing designed for a particular CI user. For example, one or more additional optional DSP units can be implemented.

The sampling locations 531, 541, 537, and 547 in the signal pathways 512 and 515 can be determined by the system 500 to include one or more locations after the A/D converters 538 and 540. For example, the digitized signal can be processed using one or more digital signal processing units (DSPs). FIG. 5D shows one optional DSP (DSP1 546 and DSP2 548) on each signal pathway 512 and 515, but the total number of DSPs implemented can vary based on the desired signal processing. DSP1 546 and DSP2 548 can be implemented, for example, as a digital filter to perform spectral modulation of the digital signal. By providing one or more sampling locations, the system 500 is capable of adapting to individual signal processing schemes unique to each CI user.

Figure 6:
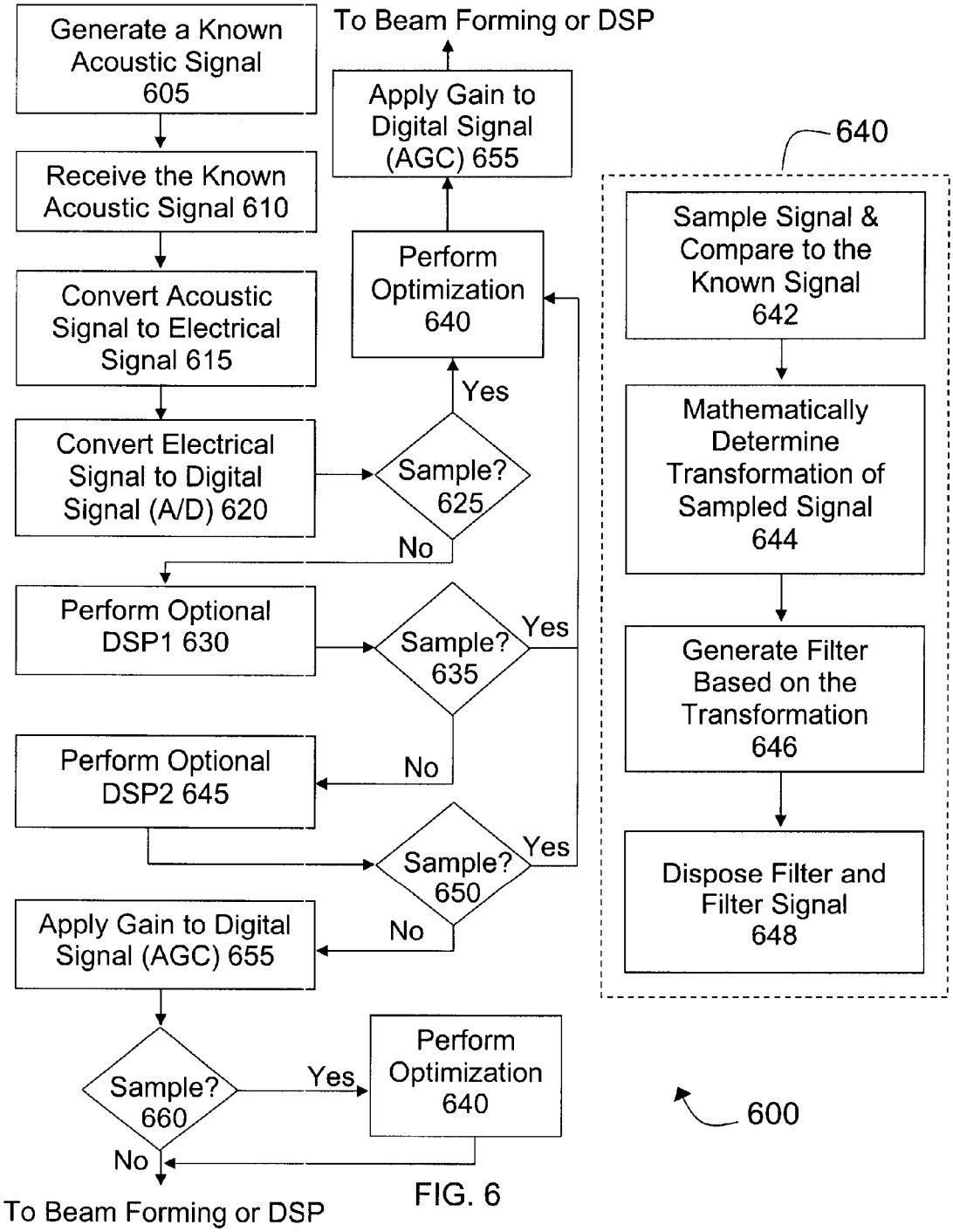
FIG. 6 is a flow chart of a process for matching responses from the two signal paths.

FIG. 6 represents a flowchart of a process 600 for matching the responses from the microphones 530 and 532. A known acoustical signal is generated and outputted by the fitting portion 550 at 605. The known acoustical signal is received by the microphone system 510 at 610. At 615, the detected acoustical signal is transformed to an electrical signal by the acoustic front ends 534, 536. At 620, the electrical signal is digitized via the A/D 538, 540. A decision can be made to sample the signal at 625. If the decision is made to sample the signal, the signal is processed for optimization at 640 before directing the signal to the AGC 542 and 544 at 655.

In one implementation, optimization of the sampled signal at 640 is performed via the fitting system 550. Alternatively, in some implementations, the sound processing system 514 is implemented to perform the optimization by disposing a DSP module (not shown) within the sound processing system 514. In other implementations, the existing DSP module 546 can be configured to perform the optimization.

Optimizing the sampled electrical signal can be accomplished through at least three signal processing events. The electrical signal is sampled and a spectrum of the sampled signal is determined at 642. The determined spectrum of the sampled signal is compared to the spectrum of the known acoustical signal to generate a ratio of the two spectrums at 644. The generated ratio represents the undesired transformation of the sampled signal due to the positioning of the microphones, mismatched characteristics of the microphones, and physical anatomy of the user's head and ear. The ratio generated is used as the basis for designing and generating an equalization filter to eliminate the undesired transformation of the sampled signal at 646. The generated equalization filter is disposed at the corresponding sampling locations 531, 541, 537, and 547 to filter the sampled signal at 648. The filtered signal is directed to the next available signal processing unit on the signal pathways 512, 515. The available signal processing unit can vary depending on the signal processing scheme designed for a particular CI user.

The transfer functions and the equalization filter based on the transfer functions generated through optimization at 640 is implemented using Equations 1 through 4.

$$S(j\omega) = F[s(t)] = \int_{-\infty}^{+\infty} s(t)e^{-i\omega t}dt \quad (1)$$

$$R(j\omega) = F[r(t)] = \int_{-\infty}^{+\infty} r(t)e^{-i\omega t}dt \quad (2)$$

$$H(j\omega) = \frac{R(j\omega)}{S(j\omega)} \quad (3)$$

$$G(j\omega) = \frac{T(j\omega)}{H(j\omega)} \quad (4)$$

The acoustic signal or stimulus generated from the sound source 552 is s(t) and has a corresponding Fourier transform S(jω). The signal captured or recorded from the microphone system 510 is r(t) and has a corresponding Fourier transform R(jω). The acoustical transfer function from the source to the microphone, H(jω), can then be characterized by Equation (3) above. If the target frequency response is specified by T(jω), then the equalization filter shape is given by Equation (4) above. This equalization filter is appropriately smoothed and then fit with a realizable equalization filter, which is then stored on the sound processing system 514 at the appropriate location(s). The digital filter can be a finite-impulse-response (FIR) filter or an infinite-impulse-response (IIR) filter. Any one of several standard methods (see, e.g., *Discrete Time Signal Processing*, Oppenheim and Schafer, Prentice Hall (1989)) can be used to derive the digital filter. The entire sequence of operation just described is performed by the fitting system 554. In some implementations, the processing events 642, 644, 646, and 684 are implemented as a single processing event, combined as two processing events or further subdivided into multiple processing events.

If the decision at 625 is to sample the digital signal, the digital signal is forwarded directly to the AGC 542, 544. Alternatively, the digital signal can be forwarded to the next signal processing unit. For example, a first optional digital signal processing (DSP1) can be presented at 630. At the conclusion of the first optional digital signal processing, another opportunity to sample the digital signal can be presented at 635. A decision to sample the digital signal at 635 instructs the fitting system 554 to perform the signal optimization at 640. The signal processing events 642, 644, 646, 648 are carried out on the digital signal to filter out the undesired transformation and match the microphone responses as described above. The filtered digital signal can then be forwarded to the AGC 542, 544 at 655 to provide protection against an overdriven or underdriven signal and to maintain an adequate demodulation signal amplitude while avoiding occasional noise spikes.

However, if the decision at 650 is not to sample the digital signal, then the digital signal is forwarded directly to the AGCs 542, 544 and processed as described above. The gain controlled digital signal is processed at 655 to allow for yet another sampling opportunity. If the decision at 660 is to sample the gain controlled digital signal, the sampled gain controlled digital signal is processed by the fitting system 554 to perform the optimization at 640. The signal processing events 642, 644, 646, and 648 are carried out on the gain controlled digital signal to filter out the undesired transformation and match microphone responses as described above. The filtered digital signal is forwarded to a beamforming module 528 for combining the signals from each signal path 512, 515.

Beamforming Calculation

Once the microphone matching process has been accomplished, the beamforming mathematical operation is performed on the two individual signals along the two signal paths 512, 515. The beamforming module 528 combines the filtered signals from signal paths 512 and 515 to provide beamforming. Beamforming provides directivity of the acoustical signal, which allows the individual CI user to focus on a desired portion of the acoustical signal. For example, in a noisy environment, the individual CI user can focus on the speech of a certain speaker to facilitate comprehension of such speech over confusing background noise.

Figure 5E:
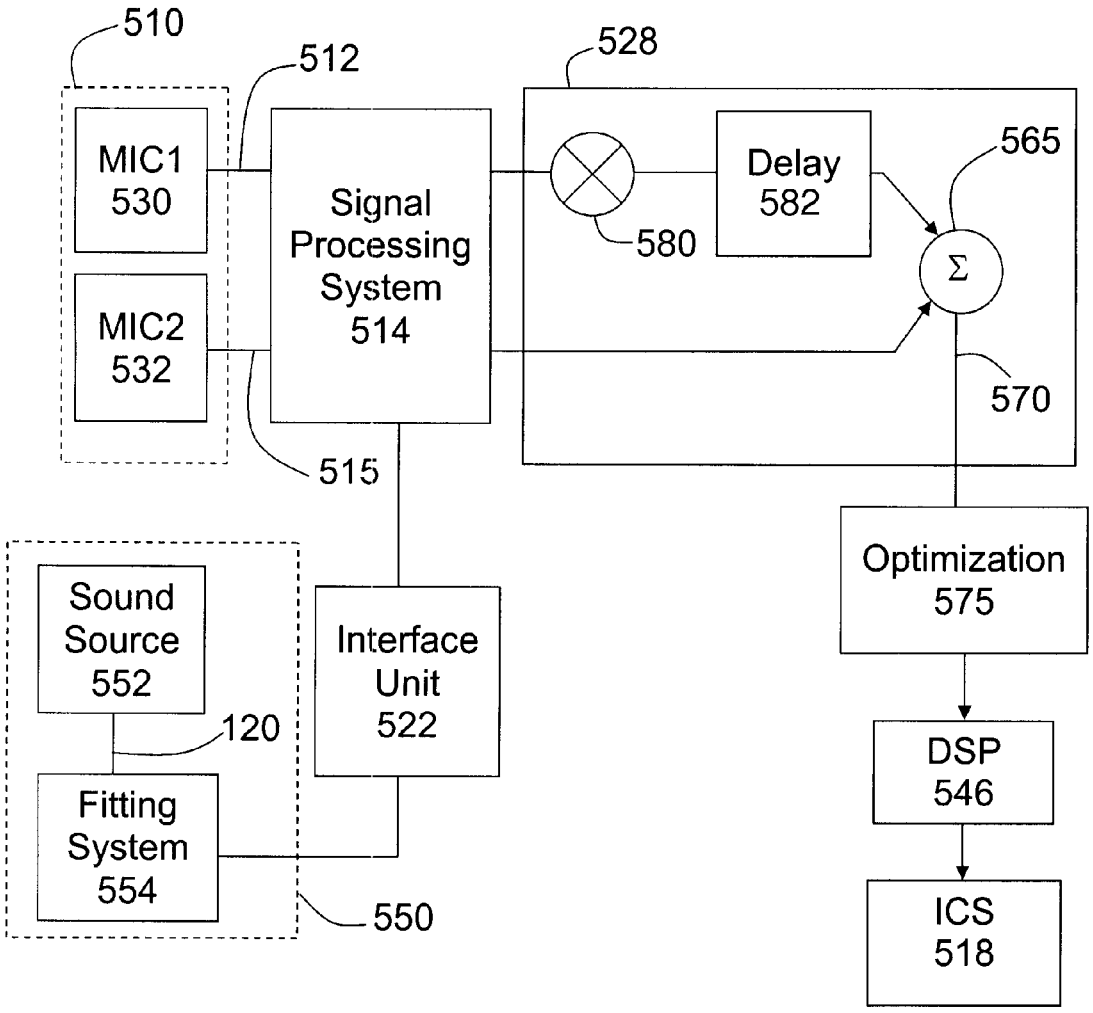
FIG. 5E is a detailed view of a beamforming module.

FIG. 5E discloses a detailed view of the beamforming module 528. Beamforming of the two microphones 530, 532 to achieve directivity of sound is implemented by subtracting the responses from the two microphones 530, 532. Directivity is a function of this signal subtraction. Two aspects of directivity, Focus and Strength, are modulated. A delay factor, Δ, defines the Focus or directivity of the beamforming, and a gain factor, α, defines the Strength of that Focus.

Beamforming provides a destructive combination of signals form the two microphones 530, 532. In other words, a first signal from the first microphone 530 is subtracted from a second signal from the second microphone 532. Alternatively, the second signal from the second microphone 532 can be subtracted from the first signal from the first microphone 530. A consequence of such destructive combination can include a spectrum shift in the combined signal. The beamforming signal (the combined signal) has directivity associated with the design parameters. However, a spectrum transformation is also generated, and a computed transformation of the beamforming signal can include a first order high pass filter. At the large wavelength (low frequency), more signal strength is lost than at the small wavelength (high frequency). In contrast, at the small wavelength, the signal strength is slightly larger than at the low frequency. In order to compensate for the spectral modification, a digital filter can be provided to counter the high pass filter response of the beamforming signal. The digital filter to compensate for the spectral modification can be determined by sampling the combined beamforming signal and comparing the sampled beamforming signal against a target signal.

A delay factor, Δ, is applied to the response from the microphone 530, 532 farthest away from the sound source 552 using a delay module 562 along the corresponding microphone signal paths 512, 515. If Δ=the back length between the two microphones 530, 532, then Focus is entirely to the front. A gain factor, α, is applied to the same response using a multiplier 560 located along the corresponding microphone signal paths 512, 515 to provide Strength of the Focus. Varying α from 0 to 1 changes the Strength of the Focus. Therefore, the delay factor, Δ, provides Focus (direction), and the gain factor, α, provides Strength of that Focus. A beamforming signal (BFS) is calculated using Equation (5).

$$BFS = MIC2 - \alpha \times (MIC1 \times \Delta) \quad (5)$$

Figure 7:
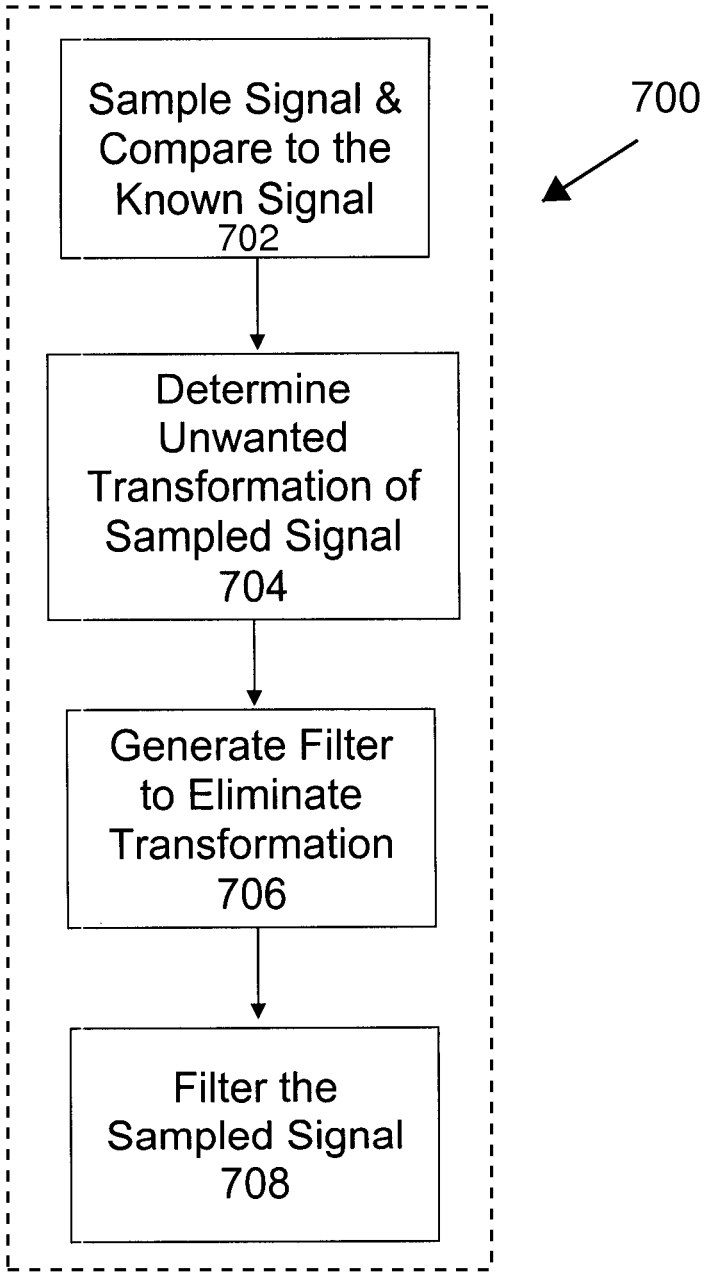
FIG. 7 is a flow chart of a process for generating a beamforming signal.

The resultant beamforming signal is forwarded to an optimization unit 575 along a combined signal path 570. The optimization unit 575 performs signal optimization 700 as described in FIG. 7 to eliminate undesired spectral transformation of the beamforming signal. The beamforming signal is sampled at 702. A spectrum of the sampled beamforming signal is determined and compared to the spectrum of the known signal at 704. A beamforming filter is generated based on the comparison at 706. The generated beamforming filter is disposed at an appropriate location along the combined signal path 570 to compensate for an undesired spectral transformation of the beamforming signal at 708. As described with respect to FIG. 6 above, the beamforming signal can be sampled at one or more locations and filtered using corresponding number of beamforming filters generated.

Modulation of the delay and gain factors, $\Delta$ and $\alpha$, can be implemented using physical selectors such as a switch or dials located on a wired or wireless control device. Alternatively, a graphical user interface can be implemented to include graphical selectors such as a button, a menu, and a tab to input and vary the delay and gain factors.

In some implementations, the gain and delay factors can be manually or automatically modified based on the perceived noise level. In other implementations, the gain and delay factors can be selectable for on/off modes.

Computer Implementation

In some implementations, the techniques for achieving beamforming as described in FIGS. 1-7 may be implemented using one or more computer programs comprising computer executable code stored on a computer readable medium and executing on the computer system 562, the sound processor portion 502, or the CI fitting portion 550, or all three. The computer readable medium may include a hard disk drive, a flash memory device, a random access memory device such as DRAM and SDRAM, removable storage medium such as CD-ROM and DVD-ROM, a tape, a floppy disk, a CompactFlash memory card, a secure digital (SD) memory card, or some other storage device. In some implementations, the computer executable code may include multiple portions or modules, with each portion designed to perform a specific function described in connection with FIGS. 5-7 above. In some implementations, the techniques may be implemented using hardware such as a microprocessor, a microcontroller, an embedded microcontroller with internal memory, or an erasable programmable read only memory (EPROM) encoding computer executable instructions for performing the techniques described in connection with FIGS. 5-7. In other implementations, the techniques may be implemented using a combination of software and hardware.

Processors suitable for the execution of a computer program include, by way of example, both general and special purpose microprocessors, and any one or more processors of any kind of digital computer, including graphics processors, such as a GPU. Generally, the processor will receive instructions and data from a read only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. Information carriers suitable for embodying computer program instructions and data include all forms of non volatile memory, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

A number of implementations have been disclosed herein. Nevertheless, it will be understood that various modifications may be made without departing from the scope of the claims. Accordingly, other implementations are within the scope of the following claims.

What is claimed is:

1. A system for assisting a patient with hearing, the system comprising:

a first microphone configured to generate a first audio signal in response to a sound, and a second microphone configured to generate a second audio signal in response to the sound;

a first processing circuit for respectively producing first and second responses from the first and second audio signals, wherein the first processing circuit delays the first response with respect to the second response in accordance with a delay period;

a subtractor for subtracting the first and second responses to create an output signal, wherein the output signal is a function of a location of the sound relative to the first and second microphones; and a second processing circuit for configuring the output signal for presentation to hardware for assisting the patient with hearing;

wherein at least one of the first microphone and the second microphones comprise an in-the-ear microphone, while the first processing circuit is within a portion located outside the ear, wherein the hardware for assisting the patient with hearing comprises an implanted portion of a cochlear implant system, and wherein the first processing circuit, the subtractor, and the second processing circuit are all within an external portion of the cochlear implant system.

2. The system of claim 1, wherein the first and second responses are matched in their frequency spectra by at least one filter in the first processing circuit.

3. The system of claim 1, wherein the first and second responses are matched in their frequency spectra by a first filter for the first response in the first processing circuit, and a second filter for the second response in the first processing circuit.

4. The system of claim 3, wherein the first and second responses are matched in their frequency spectra by matching the frequency spectrum of the first and second responses to a frequency response from a known sound.

5. The system of claim 4, further comprising a fitting system, wherein the known sound is emitted from the fitting system.

6. The system of claim 1, wherein the first processing circuit further comprises a gain adjuster for adjusting a gain of the first response.

7. The system of claim 6, wherein the gain in the first processing circuit is programmable.

8. The system of claim 1, wherein the delay period in the first processing circuit is programmable.

9. The system of claim 1, wherein the second processing circuit further comprises at least one filter for optimizing the output signal.

10. The system of claim 1, wherein the configured output signal is presented from the external portion to the implanted portion wirelessly.

11. The system of claim 1, wherein the second processing circuit further comprises a gain adjuster for adjusting a gain of the output signal.

12. The system of claim 1, further comprising a fitting system for configuring the first processing circuit.

13. The system of claim 1, wherein the in-the-ear microphone is configured to fit in an ear pinna.

14. The system of claim 1, further comprising a sound port wherein at least one of the microphones is configured to receive the sound from the sound port.

15. The system of claim 14, wherein the sound port further comprises an open end located in horizontal coplanar alignment with at least one of the microphones.

16. A method for assisting a patient with hearing, the method comprising:

generating a first audio signal from a first microphone in response to a sound and generating a second audio signal from a second microphone in response to the sound;

creating first and second responses from the first and second audio signals, wherein the first response is delayed with respect to the second response by a delay period;

forming a first output signal, wherein the first output signal comprises a difference between the delayed first response and the second response; and forming from the first output signal at least one second output signal for presentation to hardware for assisting the patient with hearing;

wherein at least one of the first and the second microphones comprise an in-the-ear microphone and the first and second responses are created in an area outside the ear, wherein the hardware for assisting the patient with hearing comprises an internal portion of an implantable cochlear system, wherein the at least one second output signal is presented from an external portion of the cochlear implant system, and wherein the at least one second output signal is presented from the external portion to the implanted portion wirelessly.

17. The method of claim 16, further comprising matching the frequency spectra of the first and second responses.

18. The method of claim 17, wherein matching is accomplished by comparing the frequency spectra of the responses to each other.

19. The method of claim 17, wherein matching is accomplished by comparing the frequency spectrum of at least one of the responses to the frequency spectrum of a known sound.

20. The method of claim 19, further comprising generating the known sound from a fitting system.

21. The method of claim 16, further comprising adjusting the delay period.

22. The method of claim 16, wherein the in-the-ear microphone is configured to fit in an ear pinna.

23. The method of claim 16, wherein the first microphone is in horizontal coplanar alignment with the second microphone.

24. The method of claim 16, wherein at least one of the microphones receives the sound from a sound port and wherein the sound port further comprises an open end located in horizontal coplanar alignment with at least one of the microphones.

25. A system for assisting a patient with hearing, the system comprising:

a first microphone configured to generate a first audio signal in response to a sound, and a second microphone configured to generate a second audio signal in response to the sound;

a first processing circuit for respectively producing first and second responses from the first and second audio signals, wherein the first processing circuit delays the first response with respect to the second response in accordance with a delay period;

a subtractor that creates an output signal as a function of a location of the sound relative to the first and second microphones by subtracting the first response from the second response; and a second processing circuit for configuring the output signal for presentation to hardware for assisting the patient with hearing;

wherein the first processing circuit, the subtractor, and the second processing circuit are all within an external portion of the cochlear implant system.

* * * * *